US005961434A

United States Patent [19]

Helseth

[11] Patent Number: 5,961,434

[45] **Date of Patent: *Oct. 5, 1999**

[54] METHOD AND APPARATUS FOR ARRANGING TWIST-TIES

[75] Inventor: James Ray Helseth, Plymouth, Minn.

[73] Assignee: Twist-Ease, Inc., Minneapolis, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/686,807

[22] Filed: Jul. 26, 1996

[51] Int. Cl.[6] ..... B31D 1/00; B65D 77/10; A47F 3/02

[52] U.S. Cl. ..... 493/352; 493/962; 156/296; 312/128; 221/26

[58] Field of Search ..... 493/352, 361–369, 493/372, 962; 52/138.6–138.8; 206/343, 338, 820; 211/162, 94, 94.5, 94.01, 94.02; 221/26; 312/128; 24/460, 462; 156/296, 908, 227, 290, 179, 178, 176; 412/6, 8, 33, 37; 40/725, 726; 402/500

[56] References Cited

U.S. PATENT DOCUMENTS

| | | | |
|---|---|---|---|
| D. 156,922 | 1/1950 | Sonntag | D23/372 |
| D. 261,452 | 10/1981 | Chandler | D6/523 |
| D. 285,719 | 9/1986 | Conlon | D23/371 |
| D. 294,908 | 3/1988 | Childress | D6/573 X |
| D. 323,594 | 2/1992 | Helseth | D6/515 |
| 628,642 | 7/1899 | Wyman . | |
| 740,001 | 9/1903 | Flanagin . | |
| 1,441,359 | 1/1923 | Langston | 493/362 |
| 2,050,394 | 8/1936 | Straubel | 493/363 |
| 2,144,263 | 1/1939 | Lane | 493/369 |
| 2,277,265 | 3/1942 | Zahniser | 412/6 |
| 2,973,597 | 3/1961 | Powell | 24/30.5 T |
| 2,984,161 | 5/1961 | Cook et al. | 493/365 |
| 3,035,925 | 5/1962 | Jackson | 206/820 |
| 3,068,135 | 12/1962 | Bower | 24/30.5 T |
| 3,207,564 | 9/1965 | Patrick et al. | D6/517 X |
| 3,290,854 | 12/1966 | MacMurray | 24/30.5 T |
| 3,409,948 | 11/1968 | Goodwin | 24/30.5 T |
| 3,420,723 | 1/1969 | Thorp | 156/908 |
| 3,468,509 | 9/1969 | Foltz | 211/162 |
| 3,774,755 | 11/1973 | Cast et al. | 206/56 DF |
| 3,783,931 | 1/1974 | Assael | 24/462 |
| 3,995,886 | 12/1976 | Starts | 156/227 |
| 4,052,886 | 10/1977 | Buick | 98/58.3 |
| 4,184,218 | 1/1980 | Hawkes | 156/908 |
| 4,281,854 | 8/1981 | Savich | 156/227 |
| 4,509,231 | 4/1985 | Paxton | 24/30.5 |
| 4,539,237 | 9/1985 | Clayton | 206/338 |
| 4,543,862 | 10/1985 | Levene et al. | 83/19 |
| 4,558,813 | 12/1985 | Richards | 229/4.5 |
| 4,566,660 | 1/1986 | Anscher et al. | 24/462 |
| 4,596,195 | 6/1986 | Wenger | 108/31 |
| 4,621,732 | 11/1986 | Olson | 206/346 |
| 4,673,324 | 6/1987 | Hanson et al. | 156/227 |
| 4,758,022 | 7/1988 | Podosek et al. | 412/4 |
| 4,815,610 | 3/1989 | Borick et al. | 211/13 X |
| 4,828,645 | 5/1989 | Van Bortel | 156/475 |
| 4,923,351 | 5/1990 | Nishikawa | 412/6 |
| 4,948,202 | 8/1990 | Helseth | 312/35 |
| 4,998,630 | 3/1991 | Schwartz | 211/162 |
| 5,092,830 | 3/1992 | Helseth | 493/962 |
| 5,112,083 | 5/1992 | Morrone | 412/33 |
| 5,119,968 | 6/1992 | Palmer | 221/26 |
| 5,213,400 | 5/1993 | Helseth | 312/35 |
| 5,232,431 | 8/1993 | Helseth | 493/962 |
| 5,412,912 | 5/1995 | Alves | 211/94.5 |
| 5,593,033 | 1/1997 | Kunreuther | 206/343 |

*Primary Examiner*—Michael J. Carone
*Assistant Examiner*—Darren Ark
*Attorney, Agent, or Firm*—Merchant & Gould P.C.

[57] ABSTRACT

A cluster of twist-ties is formed by arranging twist-ties generally parallel to one another and interconnecting the twist-ties at a common end. The twist-ties are severed proximate the common end so that a person can pull on an opposite, free end of any twist-tie to remove it from the cluster.

23 Claims, 3 Drawing Sheets

FIG.6
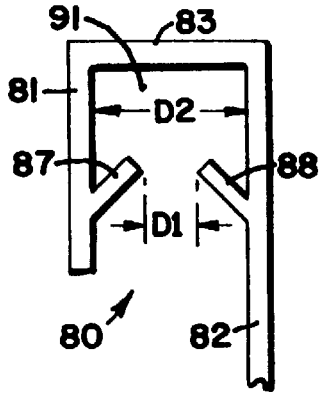
FIG.7
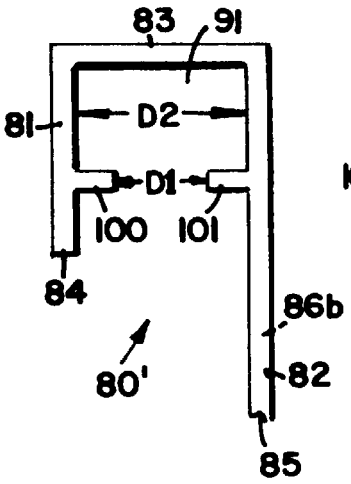
FIG.8
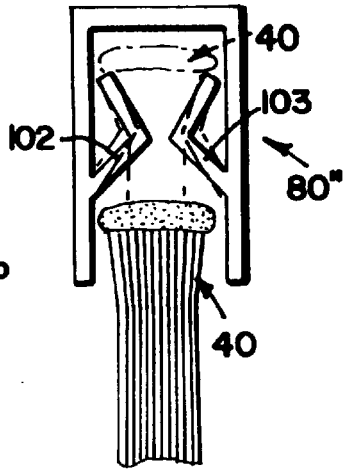
FIG.9
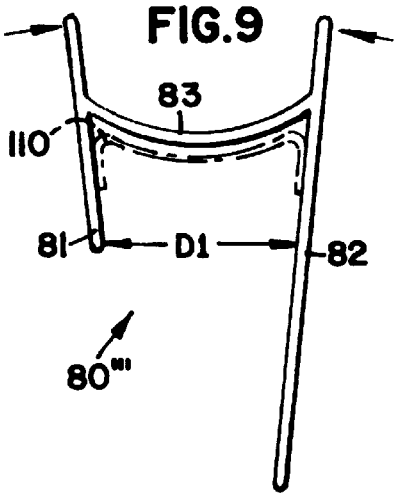
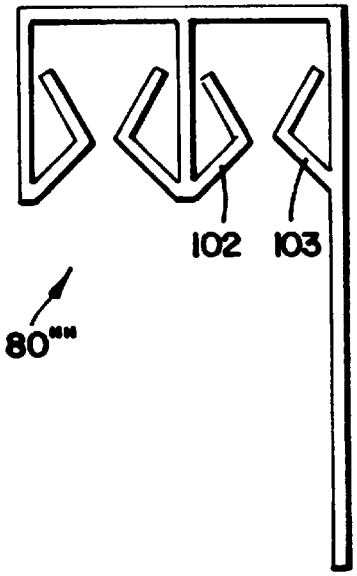
FIG.10
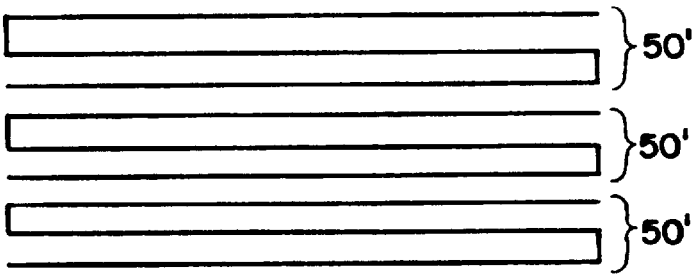
FIG.11

METHOD AND APPARATUS FOR ARRANGING TWIST-TIES

FIELD OF THE INVENTION

The present invention relates to twist-tie closure devices of the type which are often available in bulk quantities in grocery stores for the purpose, among others, of temporarily closing plastic bags containing produce, meat packages, baked goods, candies, etc.

BACKGROUND OF THE INVENTION

Twist-tie closure devices are well known in the art and widely available. They are relatively inexpensive to manufacture and easy to use. Methods of making and dispensing twist-tie closure devices are described in U.S. Pat. Nos. 5,092,830, 5,213,400, and 5,232,431. Although the methods and apparatus disclosed in these patents constitute advances in the art, additional improvements are beneficial. For example, improvements relating to the cost of manufacturing the dispensers and the effort required to keep them stocked would be useful.

SUMMARY OF THE INVENTION

The present invention provides a simple, cost effective, and reliable method and apparatus for packaging and dispensing bulk quantities of twist-tie closure devices in hygienic, organized, and spill-proof fashion. In a preferred embodiment, numerous twist-ties are secured together at one "common" end to form a cluster or bunch. Each of the twist-ties extends from this common end to an opposite "free" end. Each of the twist-ties includes a wire disposed within a strip of material which is typically paper or plastic. Each wire is severed a relatively short distance from the common end. However, at least a portion of the material is not completely severed—thereby allowing any one of the twist-ties to be removed from the cluster simply by pulling on the free end thereof with sufficient force to tear the material.

The cluster is preferably formed of several layers of twist-tie panels, wherein each panel includes two sheets of paper or plastic and a plurality of wires disposed therebetween and extending generally parallel to one another. Individual twist-ties are formed by making parallel cuts in the sheets between each of the wires and parallel thereto. Each cut extends from the free end of a respective twist-tie to a point proximate where the wire is severed.

Each panel includes a relatively small span of uncut sheets extending from the point proximate where the wires are severed to the common end.

The layers of twist-tie panels are preferably secured to one another in such a manner that the cluster is relatively thicker at the common end. In other words, the uncut portions of the twist-tie panels tend to diverge as they approach the common end. Such an arrangement results when the twist-tie panels are clamped along the line where the wires are severed while an adhesive or padding compound is applied to the uncut ends of the panels. The resulting cluster of twist-ties is suitable for insertion into a somewhat T-shaped slot which is provided on a preferred embodiment dispenser. In this manner, approximately one thousand twist-ties may be presented for use within a space of only a few cubic inches. Many advantages of the present invention will become apparent from the description that follows.

BRIEF DESCRIPTION OF THE DRAWING

With reference to the Figures of the Drawing, wherein like numerals represent like parts and assemblies throughout the several views:

FIG. 6 is a side elevation view of a preferred twist-tie dispenser 80 of FIG. 5;

FIG. 7 is a side elevation view of an alternative embodiment twist-tie dispenser 80;

FIG. 8 is a side elevation view of a second alternative embodiment twist-tie dispenser 80;

FIG. 9 is a side elevation view of a third alternative embodiment twist-tie dispenser 80;

FIG. 10 is a side elevation view of a fourth alternative embodiment twist-tie dispenser 80 which provides slots for several clusters 40; and FIG. 11 is a diagrammatic top view of an alternative embodiment wherein a cluster 40 is comprised of several sheets 50 each of which is folded back against itself.

DETAILED DESCRIPTION OF THE PREFERRED EMBODIMENT

Figure 1:
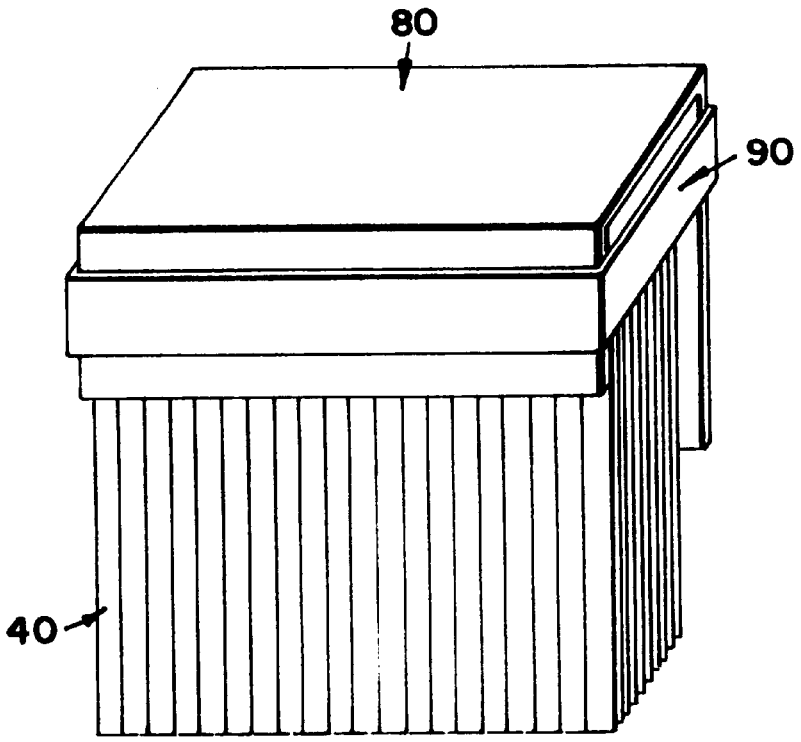
FIG. 1 is an isometric view of a twist-tie cluster 40 constructed according to the principles of the present invention and supported by a twist-tie dispenser 80 constructed according to the principles of the present invention.

In FIGS. 1–6 of the drawing, a preferred embodiment twist-tie cluster constructed according to the principles of the present invention is designated as 40, and a preferred embodiment twist-tie dispenser constructed according to the principles of the present invention is designated as 80. FIGS. 7–11 illustrate alternative embodiments of dispenser 80 and cluster 40.

In FIG. 1, the twist-tie cluster 40 is shown supported by the twist-tie dispenser 80. This particular combination is considered well suited for use in the produce section of a grocery store. Those skilled in the art will recognize that the present invention is not necessarily limited to a single application nor to the combination of the preferred embodiment twist-tie cluster 40 and the preferred embodiment twist-tie dispenser 80, since each may have utility in the absence of the other.

Figure 2:
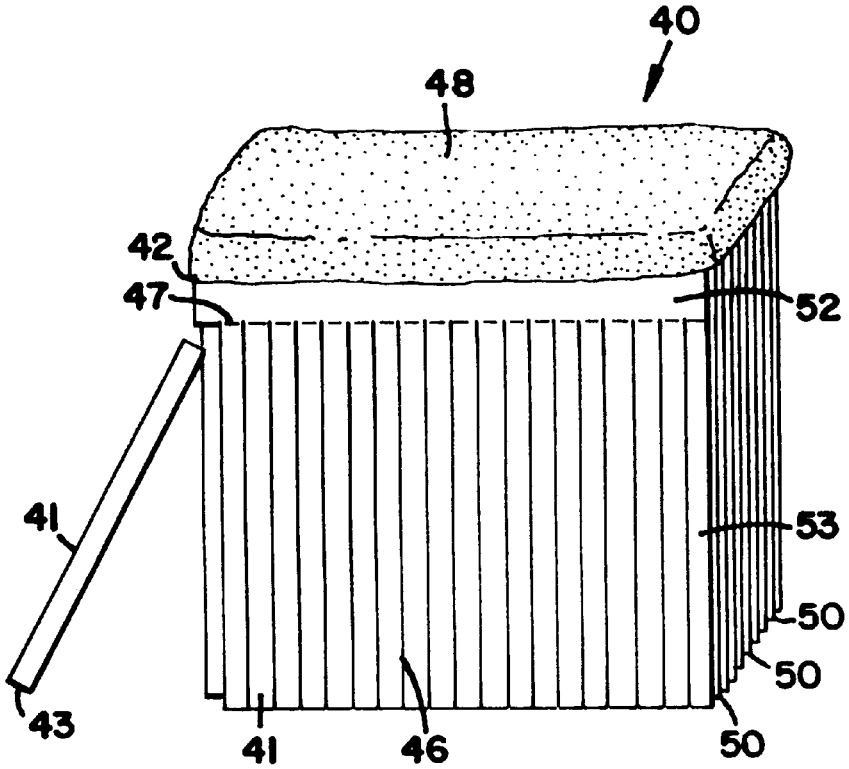
FIG. 2 is an isometric view of the twist-tie cluster 40 of FIG. 1.
Figure 3:
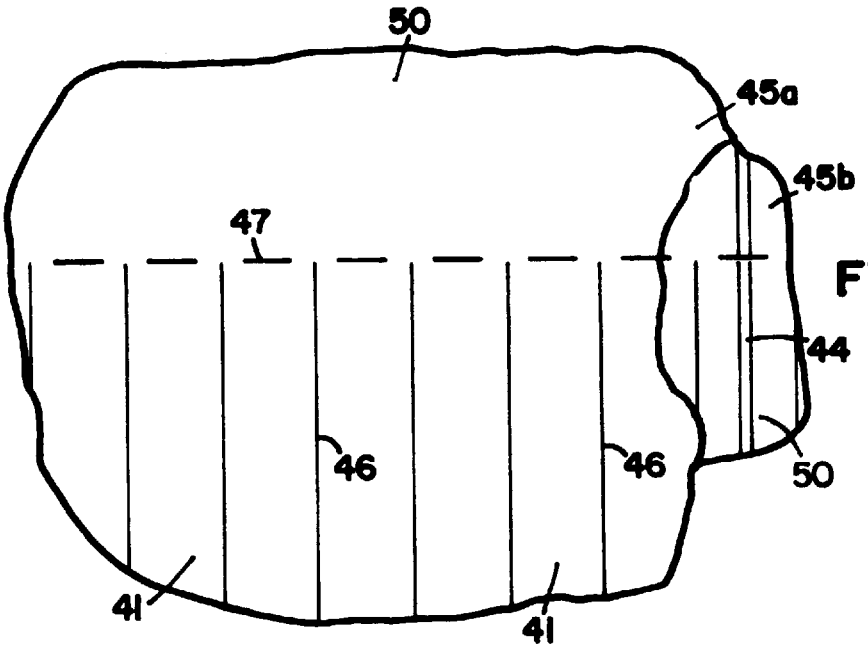
FIG. 3 is an enlarged front view of a portion of the twist-tie cluster 40 of FIG. 2.
Figure 4:
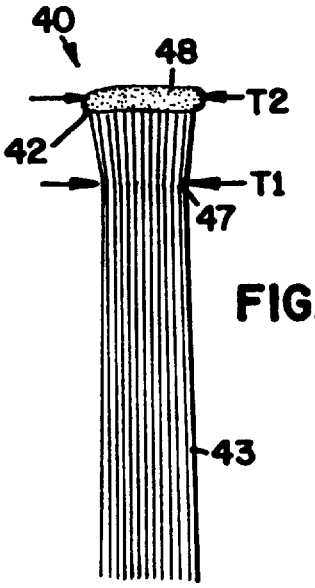
FIG. 4 is a side elevation view of the twist-tie cluster 40 of FIG. 2.
Figure 5:
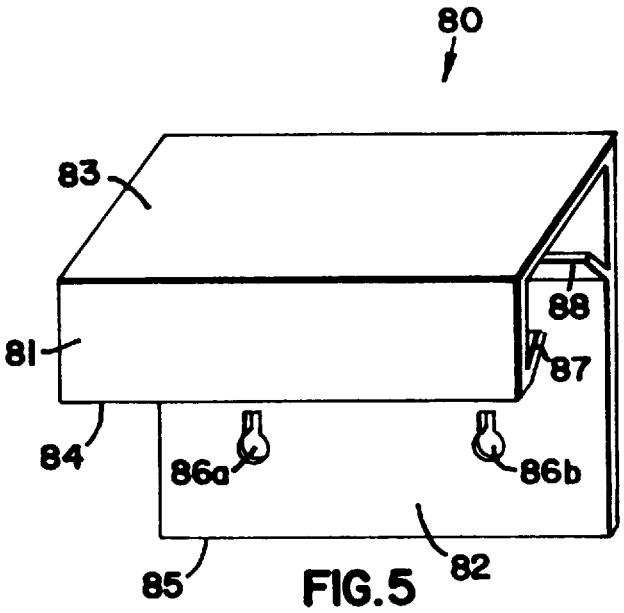
FIG. 5 is an isometric view of the twist-tie dispenser 80 of FIG. 1.

The twist-tie cluster 40 is shown in greater detail in FIGS. 2–4. The twist-tie cluster 40 includes a plurality of individual twist-ties 41, each of which extends from a first or common end 42 to a second or distal end 43. As shown in FIG. 3, each individual twist-tie 41 includes a wire 44 disposed or embedded within a carrier material, which in this case, includes two strips of paper 45*a* and 45*b*.

In the preferred embodiment, the twist-ties 41 are provided in sheets 50, each of which includes the two strips of paper 45*a* and 45*b* and a plurality of the wires 44 extending parallel to one another. The individual twist-ties 41 are formed by cutting through the paper 45*a* and 45*b* along lines 46 which are generally spaced between and parallel to the wires 44. Each sheet 50 is then subjected to an intermittent, transverse cut along a line 47 extending perpendicular to the lines 46 and proximate the common ends 42 of the twist-ties 41. The so-called "intermittent" cut severs each of the wires 44 but leaves a portion of the papers 45*a* and 45*b* intact. A first segment 52 of the twist-tie 41 is disposed above the cut line 47, and a second segment 53 of the twist-tie 41 is disposed below the cut line 47. As a result of this process, the first or upper segment 52 of each individual twist-tie 41 remains interconnected, but the second or lower segment 53 can be easily torn from the sheet 50. A method and apparatus for cutting the twist-tie sheets 50 in this manner is disclosed in U.S. Pat. No. 5,232,431.

Several sized sheets 50 may be positioned adjacent one another to form a cluster 40. Alternatively, a single sheet 50' may be folded back against itself at five inch intervals to form the cluster 40 (best seen in FIGS. 1 and 11). A cluster 40 as used herein is defined as a collection of twist-ties at least three across and at least three deep.

The cluster 40 of twist-ties is clamped in the region of the transverse cut 47, and the first ends 42 thereof are interconnected. In the preferred embodiment, the means for interconnecting the common ends 42 of the twist-ties is a suitable adhesive 48 which is applied thereto. Those skilled in the art will recognize alternatives (e.g., such as staples). In any case, the "weak link" in this arrangement is the transverse cut 47, which allows the lower segment 53 of each twist-tie 41 to be removed from the cluster 40. As shown in FIG. 4, the resulting configuration has a first thickness T1 proximate the transverse cut 47, and a second, relatively greater thickness T2 at the glued or common end 48.

Preferred and alternative embodiments of twist-tie dispenser 80 is shown in greater detail in FIGS. 5–10. The twist-tie dispenser 80 is a plastic extrusion having a uniform profile as shown in FIG. 6. The dispenser 80 includes a front wall or panel 81, a rear wall or panel 82, and a top wall or panel 83 extending perpendicular therebetween. The front wall 81 extends from its juncture with the top wall 83 down to a lower end 84. The rear wall 82 extends from its juncture with the top wall 83 down, about twice as far as the front wall 81, to a lower end 85. The length of the walls 81-83 (measured perpendicular to the profile) is slightly larger than the width of the cluster 40. Holes 86*a* and 86*b* are formed through the lower half of the rear wall 82 to facilitate mounting of the dispenser 80 to a wall or other support by means of screws or other fasteners. It will be appreciated that holes 86*a* and 86*b* may preferably be formed through rear wall 82 after the extrusion process.

A shoulder or ledge 87 extends at an upward angle from the front wall 81 and toward the rear wall 82. Another shoulder or ledge 88 extends at an upward angle from the rear wall 82 and toward the front wall 81. The ledges 87 and 88 cooperate with one another to define a depth D1 therebetween. The preferred depth of D1 is slightly less than (or equal to) the thickness T1 of the cluster 40.

This thickness provides that the dispenser 80 securely pinches or holds the cluster 40. The preferred depth of D1 is less than the thickness T2. The front wall 81 and the rear wall 82 extend parallel to one another and cooperate to define a depth D2 therebetween. The depth D2 is greater than the thickness T2 of the cluster 40. The walls 81–83 and the ledges 87-88 cooperate to define a slot 91 which is sized and configured to receive the cluster 40. In particular, the cluster 40 is inserted endwise into the dispenser 80 to arrive at the arrangement shown in FIG. 1. Thus, the dispenser 80 may be said to provide a means for mounting the twist-tie cluster 40 relative to a wall or other support surface. Further, due to the ledges 87 and 88 being oriented at an angle relative to the walls 81 and 82, a resiliency is provided to the ledges which helps urge cluster 40 up into place in the dispenser 80, as well as securing cluster 40 within dispenser 80.

As shown in FIG. 1, a rubber band 90 may optionally be secured about the walls 81–83 and across the slot of the dispenser 80 to prevent the cluster 40 from inadvertently sliding out of the slot. Those skilled in the art will recognize that such a "retaining means" could be implemented in other manners as well. The inclusion of the optional rubber band 90 facilitates the formation of an optional living hinge (not shown) in the top wall 83 to allow adjustments to the slot depths and thereby accommodate clusters of various thicknesses.

Turning next to FIGS. 7, 8, 9 and 10, several alternative embodiments of dispenser 80 are shown. In FIG. 7, dispenser 80' includes ledges 100 and 101 which extend perpendicularly from front wall 81 and rear wall 82 respectively to form a T-shaped slot 91.

FIG. 8 illustrates a dispenser 80" alternative embodiment wherein the ledges are designated 102 and 103. This embodiment provides additional resilient support for the cluster 40 when inserted into the dispenser 80". Additionally, the cluster 40 may be inserted from the bottom utilizing this configuration. It will be appreciated that the ledges 102 and 103 are sized and configured so that they are resilient and are urged back toward the respective wall to which the ledges 102 and 103 are attached when the cluster 40 is inserted. The resiliency of the plastic material of the dispenser 80" then tends to return the ledges 102 and 103 back to their initial position. This operation results in the cluster 40 being held firmly within the dispenser 80" after insertion.

FIG. 10 illustrates an alternative dispenser 80"" wherein several slots for clusters 40 are provided. Although ledges of the type designated as 102 and 103 are illustrated, other ledge types shown in the preferred and alternative embodiment might be used.

In yet another embodiment, FIG. 9 illustrates an alternative dispenser 80''' wherein the top portion 83 is curved with the front wall 81 and rear wall 82 extending beyond the top of top wall 83. The dispenser 80''' is again constructed of plastic or other resilient materials such that the top may be squeezed together to provide a greater distance D1 on inserting the cluster 40. Upon releasing pressure to the tops of the front and rear wall 81, 82 at the points indicated by the arrows, the distance D1 returns to its normal position thereby firmly holding cluster 40 within dispenser 80'''. A metallic spring 110 may also optionally be included to provide greater resiliency and holding of cluster 40.

The present invention also provides methods of arranging twist-ties into clusters. In one such method, a sheet of twist-ties has parallel wires disposed within a carrier material. The wires are severed proximate first ends thereof, and the carrier material is cut between the parallel wires from second, opposite ends to where the wires are severed. The sheet back is preferably sized according to the width of the dispenser 80, or may alternatively be folded against itself more than once at relatively equal intervals. In the latter case, the first ends of the wires on discrete folded back portions of the sheet are interconnected by an adhesive. The sheet is preferably clamped where the wires are severed so that the cluster is relatively thinner where the wires are severed and relatively thicker where the first ends are interconnected, so that the cluster may be inserted into a dispenser having a slot.

Another such method facilitates arrangement of twist-ties into a cluster at least three twist-ties across and at least three-twist ties deep. The twist-ties have a wire disposed within a carrier material and are arranged to extend generally parallel to one another. The twist-ties are interconnected at one end by an adhesive, and the wire of each twist-tie is severed proximate the interconnected end, so that a person can pull on an opposite, free end of any of the twist-ties to remove it from the cluster.

The twist-tie cluster, with or without the dispenser, provides a compact and cost effective arrangement of twist-ties suitable for presentation at a point of purchase. The twist-ties can be provided in relatively large quantities with relatively little inconvenience.

The present invention has been described with reference to preferred embodiments and applications. Yet the foregoing description will enable those skilled in the art to recognize additional embodiments and applications of and for the present invention. Accordingly, the scope of the present invention is to be limited only to the extent of the following claims.

What is claimed is:

1. A twist-tie dispenser, comprising:

a housing having a pair of opposing walls which cooperate to define a gap therebetween, the gap defining an upper gap depth and a lower gap depth, wherein the lower gap depth is less than the upper gap depth; and a plurality of twist-ties each having a wire retained within a strip of material, the twist-ties arranged into a cluster having a first portion, proximate which the twist-ties are secured together, and a second portion, proximate which each of the twist-ties is separable from the cluster, the first and second portions each having a thickness, wherein the first portion thickness is greater than the second portion thickness, the second portion is sized and configured to occupy the lower gap depth, and the first portion is sized and configured to occupy the upper gap depth and bear against the opposing walls to retain the plurality of twist-ties within the housing.

2. The twist-tie dispenser of claim 1, wherein the first portion includes an adhesive in contact with the twist-ties.

3. A twist-tie cluster, comprising:

a plurality of twist-ties, each having a wire retained within a strip of material and extending from a first end to a second end, wherein a cut is made in each of said wires between said first end and said second end, thereby defining a first segment, extending between said first end and said cut, and a second segment, extending between said cut and said second end, wherein each of said first segments and corresponding said second segments remain connected to one another by at least one uncut portion of said material; and a connecting means for connecting said first segments together to form said cluster, wherein said cluster has a width and a depth, said cluster is at least three twist-ties deep and at least three twist-ties wide, and said first segments abut each other over the depth and the width of said cluster.

4. The twist-tie cluster of claim 3, wherein said connecting means includes adhesive disposed over each said first end.

5. The twist-tie cluster of claim 3 wherein each said first end is glued to at least one other first end.

6. The twist-tie cluster of claim 3, wherein said connecting means includes a glob of adhesive into which each said first end is inserted.

7. The twist-tie cluster of claim 3, wherein said cluster includes a plurality of sheets of twist-ties placed adjacent to one another to define the depth measured perpendicular to the width.

8. The twist-tie cluster of claim 7, wherein said connecting means includes adhesive spanning overlapping portions of said sheet.

9. The twist-tie cluster of claim 3, wherein said cluster has a width, and said cluster includes a sheet of twist-ties which is folded into adjacent segments having respective widths approximately equal to said width.

10. A twist-tie dispensing system, comprising:

a plurality of twist-ties, each having a wire retained within a strip of material and extending from a first end to a second end, wherein a cut is made in each of said wires between said first end and said second end, thereby defining a first segment, extending between said first end and said cut, and a second segment, extending between said cut and said second end, wherein each of said first segments and corresponding said second segments remain connected to one another by at least one uncut portion of said material;

a connecting means for connecting said first segments together to form a cluster, wherein said cluster has a width and a depth, said cluster is at least three twist-ties deep and at least three twist-ties wide, and said first segments abut each other over the depth and the width of said cluster;

a rigid support; and a mounting means for mounting said cluster to said rigid support, whereby the application of a pulling force causes the removal of said second segments from said cluster.

11. The twist-tie dispensing system of claim 10, wherein said connecting means includes adhesive disposed over each said first end.

12. The twist-tie dispensing system of claim 10, wherein each said first end is glued to at least one other first end.

13. The twist-tie dispensing system of claim 10, wherein said connecting means includes a glob of adhesive into which each said first end is inserted.

14. The twist-tie dispensing system of claim 13, wherein said cluster has a first thickness proximate said cut which is made in each of said wires, and said cluster has a second, relatively greater thickness at said glob of adhesive, and said mounting means includes opposing ledges on said rigid support, and said first thickness is disposed between said ledges, and said glob of adhesive is supported on top of said ledges.

15. The twist-tie dispensing system of claim 14, wherein said rigid support includes walls which cooperate with said opposing ledges to define a slot having a profile sized and configured to receive said cluster.

16. The twist-tie dispensing system of claim 15, wherein said opposing ledges and said walls are integrally connected to one another.

17. The twist-tie dispensing system of claim 10, wherein said cluster includes a plurality of sheets of twist-ties placed adjacent to one another to define the depth measured perpendicular to the width.

18. The twist-tie dispensing system of claim 17, wherein said connecting means includes adhesive spanning overlapping portions of said sheet.

19. The twist-tie dispensing system of claim 10, wherein said cluster has a width, and said cluster includes a sheet of twist-ties which is folded into adjacent segments having respective widths approximately equal to said width.

20. The twist-tie dispensing system of claim 10, further comprising a retaining means bounded by said rigid support for retaining said cluster within a slot.

21. A method of arranging twist-ties into a cluster, comprising the steps of:

providing a sheet of twist-ties having parallel wires disposed within a carrier material;

severing the wires proximate first ends thereof, cutting slits in the carrier material between the parallel wires from second, opposite ends to where the wires are severed;

folding the sheet, about lines extending parallel to the wires, to provide overlying layers of twist-ties; and connecting the first ends of the wires after folding the sheet to provide overlying layers of twist-ties.

22. The method of claim 21, wherein said connecting step involves placing the first ends in communication with an adhesive.

23. The method of claim 22, further comprising the steps of clamping the sheets proximate where the wires are severed so that the cluster is relatively thinner proximate where the wires are severed and relatively thicker where the first ends are connected, and inserting the first ends into a dispenser having a slot with a T-shaped profile.

* * * * *